US011217141B2

(12) United States Patent
Zuo et al.

(10) Patent No.: US 11,217,141 B2
(45) Date of Patent: Jan. 4, 2022

(54) GAMMA CORRECTION METHOD AND APPARATUS, DISPLAY APPARATUS, COMPUTER STORAGE MEDIUM

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Kun Zuo, Beijing (CN); Chuanyan Lan, Beijing (CN); Guoqiang Wu, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 43 days.

(21) Appl. No.: 16/652,177

(22) PCT Filed: Oct. 17, 2019

(86) PCT No.: PCT/CN2019/111705
§ 371 (c)(1),
(2) Date: Mar. 30, 2020

(87) PCT Pub. No.: WO2020/206970
PCT Pub. Date: Oct. 15, 2020

(65) Prior Publication Data

US 2021/0233449 A1 Jul. 29, 2021

(30) Foreign Application Priority Data

Apr. 8, 2019 (CN) ..... 201910277543.0

(51) Int. Cl.
*G09G 3/20* (2006.01)

(52) U.S. Cl.
CPC ..... *G09G 3/20* (2013.01); *G09G 2320/0276* (2013.01); *G09G 2320/0633* (2013.01); *G09G 2340/0407* (2013.01)

(58) Field of Classification Search
CPC ..... G09G 3/20; G09G 2320/0276; G09G 2320/0633; G09G 2340/0407
See application file for complete search history.

(56) References Cited

U.S. PATENT DOCUMENTS 8,111,223 B2 2/2012 Yeo et al.
9,520,096 B2 12/2016 Asano et al.
(Continued)

FOREIGN PATENT DOCUMENTS

CN 101494025 A 7/2009
CN 101673518 A 3/2010
(Continued)

OTHER PUBLICATIONS

International Search Report dated Jan. 16, 2020, issued in counterpart application No. PCT/CN2019/111705 (12 pages).
(Continued)

*Primary Examiner* — Stephen G Sherman
(74) *Attorney, Agent, or Firm* — Westerman, Hattori, Daniels & Adrian, LLP

(57) ABSTRACT

The disclosure relates to a gamma correction method. The gamma correction method may include controlling a display panel to perform image display, the display panel comprising a plurality of display subareas and at least two of the plurality of display subareas having different resolutions; obtaining display brightness of the plurality of display subareas performing image display; and performing gamma correction on the display panel based on the display brightness of the plurality of display subareas respectively to obtain a correction parameter of each of the plurality of
(Continued)

display subareas. An image displayed by the display panel may have an image resolution that is greater than a resolution of at least one of the plurality of display subareas.

9 Claims, 6 Drawing Sheets

(56) References Cited

U.S. PATENT DOCUMENTS

| | | | | |
|---|---|---|---|---|
| 9,747,851 | B2 | 8/2017 | Zhang et al. | |
| 2002/0141614 | A1* | 10/2002 | Lin | H04N 19/17 382/103 |
| 2004/0174388 | A1 | 9/2004 | Sempel et al. | |
| 2006/0012606 | A1* | 1/2006 | Hiraki | G09G 3/2011 345/590 |
| 2008/0218457 | A1 | 9/2008 | Lee et al. | |
| 2016/0196793 | A1* | 7/2016 | Xu | G09G 3/3611 345/694 |

FOREIGN PATENT DOCUMENTS

| | | | |
|---|---|---|---|
| CN | 102201210 | A | 9/2011 |
| CN | 103310752 | A | 9/2013 |
| CN | 103474016 | A | 12/2013 |
| CN | 104992683 | A | 10/2015 |
| CN | 105096896 | A | 11/2015 |
| CN | 105206239 | A | 12/2015 |
| CN | 107492335 | A | 12/2017 |
| CN | 107731152 | A | 2/2018 |
| CN | 109979389 | A | 7/2019 |
| JP | 2006-184619 | A | 7/2006 |

OTHER PUBLICATIONS

Office Action dated Apr. 3, 2020, issued in counterpart CN application No. 201910277543.0, with English translation (17 pages).

* cited by examiner

GAMMA CORRECTION METHOD AND APPARATUS, DISPLAY APPARATUS, COMPUTER STORAGE MEDIUM

CROSS-REFERENCE TO RELATED APPLICATIONS

This application claims benefit of the filing date of Chinese Patent Application No. 201910277543.0 filed on Apr. 8, 2019, the disclosure of which is hereby incorporated in its entirety by reference.

TECHNICAL FIELD

The present disclosure relates to the field of display technologies, and in particular, to a gamma correction method and apparatus, a display apparatus, and a computer storage medium.

BACKGROUND

At present, in order to ensure the optical erect of the display panel, it is usually necessary to perform gamma correction on the prepared display panel. Gamma correction is a process of adjusting the display panel so that the display brightness of the display panel is ideal.

In the related art, the process of performing gamma correction on the display panel is: obtaining display brightness of a display panel when controlling the display panel to display a testing image; when the display brightness is different from the ideal brightness determined based on the testing image, the amplitude of the data signal supplied to the display panel is adjusted until the display brightness of the display panel is the same as the ideal brightness. Among them, the ideal brightness is determined based on gray scales of the testing image. The gray scale indicates the level of the shade of the image, and the brightness indicates the brightness of the image. However, the gamma correction method in the related art can only correct a display panel having a uniform pixel density, and cannot correct a display panel having a non-uniform pixel density.

BRIEF SUMMARY

An embodiment of the present disclosure provides a gamma correction method. The gamma correction method may include controlling a display panel to perform image display, the display panel comprising a plurality of display subareas and at least two of the plurality of display subareas having different resolutions; obtaining display brightness of the plurality of display subareas performing image display; and performing gamma correction on the display panel based on the display brightness of the plurality of display subareas respectively to obtain a correction parameter of each of the plurality of display subareas. An image displayed by the display panel may have an image resolution that is greater than a resolution of at least one of the plurality of subareas.

Optionally, controlling the display panel to perform the image display comprising controlling the display panel to display a plurality of images having different image resolutions in a time-sharing manner, the plurality of images having the image resolutions correspondingly equal to resolutions of the plurality of display subareas respectively; wherein one of the plurality of display subareas displays one of the plurality of images with a target resolution, which is the lower resolution between a resolution of the one of the plurality of display subareas and an image resolution of the one of the plurality of images.

Optionally, obtaining the display brightness of the plurality of display subareas performing image display comprising using a display brightness of a second display subarea among the plurality of display subareas as a display brightness of a first display subarea among the plurality of display subareas, wherein a display area of the first display subarea among the plurality of display subareas is smaller than a reference area threshold; the first display subarea has a same resolution as the image resolution of the image, and the second display subarea is a subarea, among the plurality of display subareas, that is different in resolution from the first display subarea and has a display area greater than the reference area threshold.

Optionally, performing the gamma correction on the display panel based on the display brightness of the plurality of display subareas respectively to obtain a correction parameter of each of the plurality of display subareas comprises performing the gamma correction on the display panel based on the display brightness of each of the plurality of display subareas having any resolution to obtain a correction parameter of each of the plurality of display subareas having any resolution.

Optionally, the gamma correction is performed in an order from low to high resolutions of the plurality of display subareas to obtain correction parameters of the display subareas having the corresponding resolutions.

Optionally, performing the gamma correction on the display panel based on the display brightness of the plurality of display subareas respectively to obtain a correction parameter pf each of the plurality of display subareas comprises performing the gamma correction on the display panel based on the display brightness of a display subarea having a reference resolution to obtain a correction parameter of the display subarea having the reference resolution; and determining correction parameters of the display subareas having other resolutions based on mapping relationship and the correction parameter of the display subarea having the reference resolution, wherein the other resolutions are resolutions other than the reference resolution, and the mapping relationship is configured to reflect relationship between the correction parameter of the display subarea having the reference resolution and the correction parameters of the display subareas having the other resolutions.

Optionally, performing the gamma correction on the display panel based on the display brightness of the plurality of display subareas respectively to obtain a correction parameter of each of the plurality of display subareas comprises determining a reference brightness of the display panel when displaying the image based on a gray scale of the image; adjusting an amplitude of a data signal provided to one of the display subareas until a display brightness of the one of the display subareas is the same as the reference brightness if the display brightness of the one of the display subareas is different from the reference brightness; and determining a correction parameter of the one of the display subareas at the reference brightness based on the amplitude of the adjusted data signal.

Optionally, the first display subarea has a first resolution smaller than a second resolution of the second display subarea, and the display area of the second display subarea is larger than the display area of the first display subarea, the method comprises controlling the first display subarea and the second display subarea to display a first image with the first resolution according to a first reference brightness; acquiring a first display brightness of the second display subarea; performing gamma correction on the display panel based on the first display brightness and the first reference brightness to obtain a correction parameter of the first display subarea at the first reference brightness; controlling the first display subarea and the second display subarea to display a second image with the second resolution according to a second reference brightness; acquiring a second display brightness of the second display subarea; and performing gamma correction on the display panel based on the second display brightness and the second reference brightness to obtain a correction parameter of the second display subarea at the second reference brightness.

Optionally, The method further comprises storing the correction parameter of each display subarea, and drive pixel units in the corresponding display subarea according to the stored correction parameter of each display subarea during the display process.

One embodiment of the present disclosure is a gamma correction apparatus, comprising a control module, configured to control a display panel to perform image display, the display panel includes at least two display subareas having different resolutions, a image displayed by the display panel has an image resolution that is at least greater than a resolution of one of the display subareas; an acquisition module, configured to acquire display brightness of a plurality of display subarea performing the image display; and a correction module, configure to perform gamma correction on the display panel based on the display brightness of the plurality of display subareas respectively to obtain a correction parameter of each of the plurality of display subareas.

Optionally, the control model is further configured to control the display panel to display a plurality of images having different image resolutions in a time sharing manner, the plurality of images have image resolutions correspondingly equal to resolutions of the plurality of display subareas; wherein one of the plurality of display subareas displays one of the plurality of images with a target resolution, which is the lower resolution between a resolution of the one of the plurality of display subareas and an image resolution of the one of the plurality of images.

Optionally, the acquisition module is further configured to use a display brightness of a second display subarea among the plurality of display subareas as a display brightness of a first display subarea among the plurality of display subareas, wherein a display area of the first display subarea among the plurality of display subareas is smaller than a reference area threshold; the first display subarea has a same resolution as the image resolution of the image, and the second display subarea is a subarea, among the plurality of display subareas, that is different in resolution from the first display subarea and has a display area greater than the reference area threshold.

Optionally, the correction module is configured to perform the gamma correction on the display panel based on the display brightness of each of the plurality of display subareas having any resolution to obtain a correction parameter of each of the plurality of display subareas having any resolution.

Optionally, the correction module is configured to perform the gamma correction on the display panel based on the display brightness of a display subarea having a reference resolution to obtain a correction parameter of the display subarea having the reference resolution; and determine correction parameters of the display subareas having other resolutions based on mapping relationship and the correction parameter of the display subarea having the reference resolution, wherein the other resolutions are resolutions other than the reference resolution, and the mapping relationship is configured to reflect relationship between the correction parameter of the display subarea having the reference resolution and the correction parameters of the display subareas having the other resolutions.

Optionally, the correction module is configured to determine a reference brightness of the display panel when displaying the image based on a gray scale of the image; adjust an amplitude of a data signal provided to one of the display subareas until a display brightness of the one of the display subareas is the same as the reference brightness if the display brightness of the one of the display subareas is different from the reference brightness; and determine a correction parameter of the one of the display subareas at the reference brightness based on the amplitude of the adjusted data signal.

Optionally, the first display subarea has a first resolution smaller than a second resolution of the second display subarea, and the display area of the second display subarea is larger than the display area of the first display subarea, the control module is configured to control the first display subarea and the second display subarea to display a first image with the first resolution according to a first reference brightness; the acquisition module is configure to acquire a first display brightness of the second display subarea; the correction module is configured to perform gamma correction on the display panel based on the first display brightness and the first reference brightness to obtain a correction parameter of the first display subarea at the first reference brightness; the control module is further configured to control the first display subarea and the second display subarea to display a second image with the second resolution according to a second reference brightness; the acquisition module is further configured to acquire a second display brightness of the second display subarea; and the correction module is further configured to perform gamma correction on the display panel based on the second display brightness and the second reference brightness to obtain a correction parameter of the second display subarea at the second reference brightness.

One embodiment of the present disclosure is a display apparatus, comprising a display panel and a minima correction apparatus according to one embodiment of the present disclosure, wherein the gamma correction apparatus is configured to perform gamma correction on the display panel.

Optionally, the display apparatus further comprises a target function assembly, wherein the display panel includes a plurality of display subareas with different resolutions, and an orthographic projection of the target function assembly on the display panel covers an orthographic projection of the display subarea having a resolution smaller than a reference resolution threshold on the display panel, and the target function assembly operates based on light incident from a display side of the display panel.

Optionally, the target function assembly comprises at least one of the following: a camera assembly, a light sensor assembly or a fingerprint detection assembly.

One embodiment of the present disclosure is a gamma correction apparatus, comprising: a processor and a memory, wherein, the memory is configured for storing computer programs, the processor is configured for executing a computer program stored on the memory to implement the gamma correction method as in one embodiment of the present disclosure.

DETAILED DESCRIPTION

Figure 1:
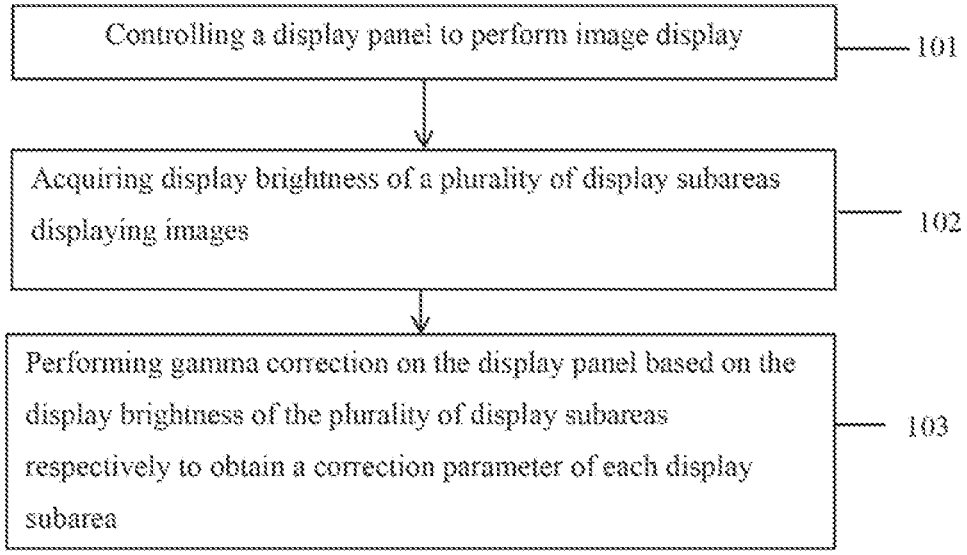
FIG. 1 is a flowchart of a gamma correction method according to an embodiment of the present disclosure.

In order to make the objects, technical solutions and advantages of the present disclosure more clear, the embodiments of the present disclosure will be further described in detail below with reference to the accompanying drawings.

Moreover, the terms "first" and "second" are used for descriptive purposes only and are not to be construed as indicating or implying a relative importance or implicitly indicating the number of technical features indicated. Thus, features defining "first" or "second" may include at least one of the features, either explicitly or implicitly. In the description of the present disclosure, the meaning of "a plurality" is at least two, such as two, three, etc., unless specifically defined otherwise.

In the description of the present specification, the description with reference to the terms "one embodiment", "some embodiments", "example", "specific example", or "some examples" and the like means a specific feature described in connection with the embodiment or example. A structure, material or feature is included in at least one embodiment or example of the disclosure. In the present specification, the schematic representation of the above terms is not necessarily directed to the same embodiment or example. Furthermore, the particular features, structures, materials, or characteristics described may be combined in a suitable manner in any one or more embodiments or examples. In addition, those skilled in the art can combine and combine the different embodiments or examples described in the specification and the features of different embodiments or examples, without contradicting each other.

In order to increase the screen ratio of the display panel, a function assembly such as a camera may be disposed below some of display subareas in the display panel. In this case, in order to ensure that the function assembly can work based on the light incident from the display side of the display panel, it is necessary to reduce the pixel density (pixels per inch, PPI) of the part of the display subareas so that the light can pass through the gap of the pixel units. This can result in uneven pixel density on the display panel, in particular, when the display panel is an Active-matrix organic light emitting diode (AMOLED) display panel.

In this case, the display subareas having different resolutions display different brightness when display according to the same reference brightness (also referred to as ideal brightness). For example, when displaying at a relatively low reference brightness, a display subarea with a relatively high resolution may be able to display normally. However, the display brightness of a display subarea having a relatively low resolution may appear to be almost invisible, thereby causing the visibility of the display panel to be affected. Alternatively, the display subarea with a relatively high resolution and the display subarea with a relatively low resolution can both display normally when displayed at a relatively high reference brightness. At the expense of this, however, the current flowing through the pixel units in the display subarea with the relatively low resolution is large, which affects the lifetime of the display subarea with the relatively low resolution. Among them, the reference brightness is also called the ideal brightness. The ideal brightness can be understood as the expected brightness that the pixel unit displays when the data signal of a certain amplitude is supplied to the pixel unit. The resolution is characterized by the density of the pixel units in the display panel.

In the related art, when gamma correction is performed on the display panel, the display brightness of the display panel is generally obtained when the display panel is controlled to display the testing image. When the display brightness is different from the ideal brightness determined based on the testing image, the amplitude of the data signal provided to all the pixel units in the display panel is synchronously adjusted until the display brightness of the display panel is the same as the ideal brightness (or within the error range). The correction parameter of all pixel units in the entire display panel is determined according to the amplitude of the adjusted data signal.

However, when the pixel density in the display panel is not uniform, the display brightness of different display subareas is different according to the same reference brightness. When the display brightness of the display panel is the same as the ideal brightness, in a display subarea having a relatively high resolution and a display subarea having a relatively low resolution, at least one of the display subareas has a display brightness different from an ideal brightness. At this time, if the correction parameter of all the pixel units in the display panel is still synchronously determined according to the related art, the accuracy of the determined correction parameters is low, and the accuracy of gamma correction on the display panel is low, thereby affecting the display effect of the display panel. Among them, the influence on the display effect mainly manifests as affecting the image quality uniformity and visibility of the display panel.

One embodiment of the present disclosure provides a gamma correction method, which can perform gamma correction for different display subareas respectively, and improve the granularity of gamma correction on the display panel. The accuracy of gamma correction of the display panel can be improved, so that the correction method can be applied to gamma correction of a display panel having a non-uniform pixel density. FIG. 1 is a flowchart of a gamma correction method according to an embodiment of the present disclosure. As shown in FIG. 1, the method includes the following steps:

Step 101: Controlling a display panel to perform image display. The display panel includes at least two display subareas having different resolutions. The image displayed by the display panel has an image resolution that is greater than a resolution of at least one of the display subareas.

The display panel includes at least two display subareas having mutually different resolutions, that is, the display panel has a plurality of display subareas, and the plurality of display subareas have different resolutions. The resolution of each of the plurality of display subareas may be different, or the resolutions of some of the plurality of display subareas are the same and the resolutions of some of the display subareas are different.

Step 102: Acquiring display brightness of a plurality of display subareas displaying images.

Step 103: Performing gamma correction on the display panel based on the display brightness of the plurality of display subareas respectively to obtain a correction parameter of each display subarea.

The correction parameter may be a circuit parameter of the driving circuit after the driving circuit of the display panel is adjusted by the gamma correction process.

The gamma correction method provided by one embodiment of the present disclosure acquires display brightness of a plurality of display subareas displaying images to perform gamma correction on the display panel based on the display brightness of the plurality of display subareas respectively, and obtains a correction parameter of each display subarea. Compared with the related art, the gamma correction according to one embodiment of the present disclosure can be performed separately for different display subareas, which improves the granularity of gamma correction on the display panel. It can be applied to gamma correction of a display panel with ununiformed pixel density, which ensures the accuracy of gamma correction of the display panel, thereby ensuring the display effect of the display panel.

Figure 2:
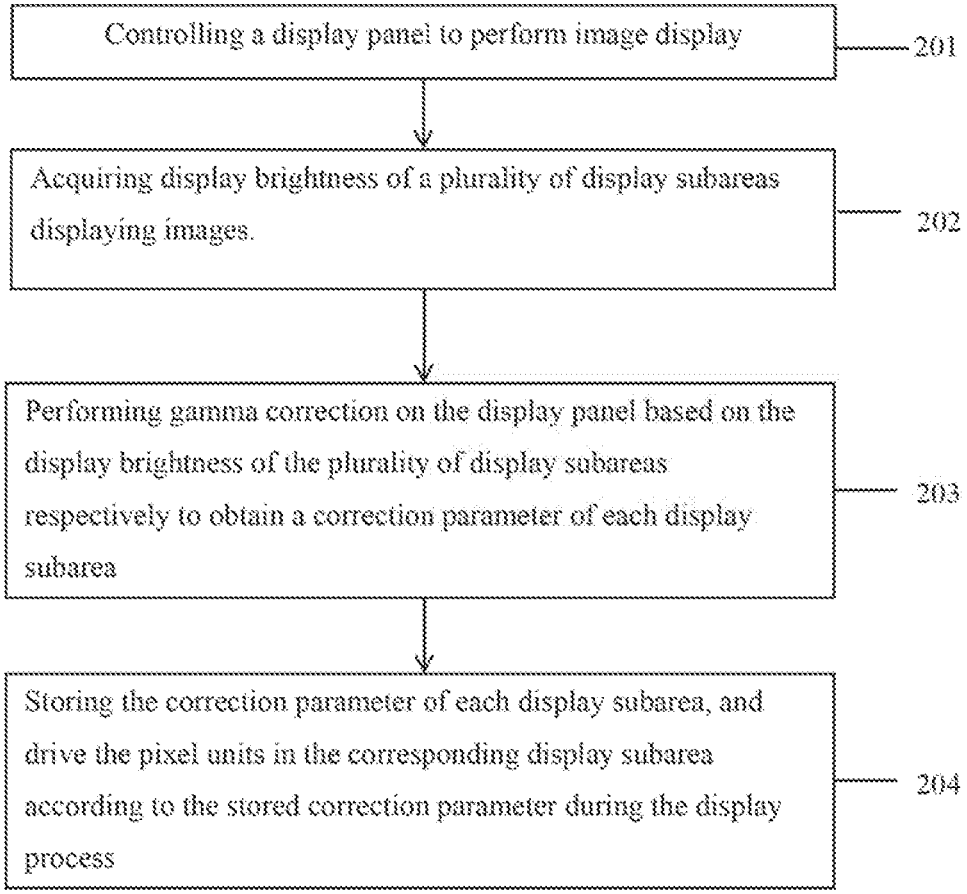
FIG. 2 is a flowchart of another gamma correction method according to an embodiment of the present disclosure.

FIG. 2 is a flowchart of a gamma correction method according to an embodiment of the present disclosure. As shown in FIG. 2, the method may include the following steps:

Step 201: Controlling a display panel to perform image display. The display panel includes at least two display subareas having different resolutions. The image displayed by the display panel has an image resolution that is greater than a resolution of at least one display subarea.

There is a plurality of implementation manners of the step 201. The following two implementation manners are respectively taken as an example as described in the following:

In a first implementation manner of step 201, the display panel can be controlled to display a plurality of images having different image resolutions in a time-sharing manner. The plurality of images have image resolutions corresponding to resolutions of the plurality of display subareas respectively, and an image resolution of at least one of the plurality of images is greater than a resolution of one of the display subareas.

Wherein, when any image is displayed on the display panel, an display subarea performs display of the image with a target resolution, which is the lower resolution between the resolution of the display subarea and the image resolution of the image.

Because when the display panel displays an image with an image resolution greater than the resolution of one display subarea in the display panel, the display subarea having a resolution greater than or equal to the image resolution (for convenience of description, hereinafter referred to as a higher resolution display subarea) displays according to the image resolution, and the display subarea having a resolution smaller than the image resolution (for convenience of description, hereinafter referred to as a lower resolution display subarea) displays according to the resolution of the display subarea. Because the pixel densities of the two are different, when the higher resolution display subarea and the lower resolution display subarea are controlled to display the image according to the same reference brightness, the display brightness of the two will be different. Therefore, it is possible to ensure that the display brightness of the display subareas of different resolutions is obtained.

Optionally, when the resolution of the display subarea is higher than the image resolution, some pixel units in the display subarea may not be displayed during display in order to achieve that the display subarea exhibits a resolution equal to the image resolution during display.

For example, assume that the display panel has two display subareas, the resolution of the High Resolution Area (HRA) is 1920×1080, and the resolution of the Low Resolution Area (LRA) is 1440×900. Correspondingly, it is possible to in a time-sharing manner control the display panel to display an image with an image resolution of 1920×1080 and an image with an image resolution of 1440×900. When the display panel displays the image with the image resolution of 1140×900, all the pixel units in the low resolution area can be controlled for display, so that the low resolution area is displayed according to the target resolution of 1140×900, and some of the pixel units in the high resolution area can be controlled for not display, so that the high resolution area is displayed according to the target resolution of 1440×900. When the image with the image resolution of 1920×1080 is displayed on the display panel, all the pixel units in the low resolution area and the high resolution area can be controlled to be displayed, so that the low resolution area is displayed according to the target resolution of 1440×900 and the high resolution area is displayed at a target resolution of 1920×1080.

Wherein, that the image resolution corresponds to the resolution of the display subarea means that the image resolution and the resolution of the display subarea may be equal (or approximately equal). Alternatively, the image resolution and the resolution of the display subarea may be unequal, as long as there is a corresponding relationship between the two, which is not specifically limited in some embodiments of the present disclosure. In one embodiment, when the image resolution and the resolution of the display subarea are equal, the display subarea can display the image with a corresponding image resolution as close as possible according to the resolution it has. The acquired display brightness can more accurately reflect the display condition of the display subarea. When the gamma correction is performed according to the display brightness, the accuracy of the correction can be further improved.

Optionally, when controlling the display panel to display a plurality of images having different image resolutions in a timesharing manner, the display panel may be respectively controlled to display according to the corresponding image resolution from low to high. In this way, the influence on the display brightness of the display subarea having a relatively low resolution during display can be reduced to some extent.

In a second implementation manner of step 201, the display panel can be controlled to display an image having an image resolution that is greater than a resolution of at least one display subarea.

When the display panel displays an image whose image resolution is greater than the resolution of at least one display subarea, the relatively high resolution display subarea is displayed according to the image resolution and the relatively low resolution display subarea will be displayed according to the resolution of the display subarea. At this time, since the pixel densities of the two are different, when the relatively high resolution display subarea and the relatively low resolution display subarea are controlled to display the image, and when the display is performed according to the same reference brightness, the display brightness of the two will be different. Therefore, it is possible to acquire the display brightness of the display subareas of different resolutions.

When the display panel is displayed according to the second implementation manner, the operation caused by the timesharing display can be reduced, and the gamma correction process is simplified.

Step 202: Acquiring display brightness of a plurality of display subareas that display images.

When the implementation manner of controlling the display panel to display is different, the implementation of the step 202 is also different. The following describes the implementation manners of the step 202 for the two implementable manners of the step 201:

Corresponding to the first implementation manner of the step 201, the first implementation manner of the step 202 may include the following: when the display panel displays any image, when the display area of the first display subarea among the plurality of display subareas is smaller than a reference area threshold, the display brightness of the second display subarea is used as the display brightness of the first display subarea. When the display area of the first display subarea is greater than or equal to the reference area threshold, the display brightness of the first display subarea is measured.

Wherein, the first display subarea has the same resolution as the image resolution of any image, and the second display subarea is a subarea, among the plurality of display subareas, that is different in resolution from the first display subarea and has a display area greater than the reference area threshold.

The reference area threshold can be adjusted according to actual needs. For example, the reference area threshold may be equal to the effective light metering area of a tool (e.g., a color analyzer) for measuring display brightness, and the effective light metering area is typically determined by the diameter of the light metering probe of the measuring tool. Furthermore, when the reference area threshold is determined according to the effective light metering area of the tool for measuring the display brightness, obtaining the display brightness of the first display subarea according to the implementation manner can solve the problem that the display brightness cannot be measured by the measuring tool when the display area of the first display subarea is smaller than the effective light metering area.

Moreover, the second display subarea may be a display subarea, among the plurality of display subareas, having a resolution greater than the resolution of the first display subarea and a display area greater than the reference area threshold. In this case, since the second display subarea has a resolution greater than the first display subarea, it can be determined that the second display subarea has a resolution greater than an image resolution of the displayed image. Thus, in the display process, the second display subarea is displayed at the image resolution. At this time, the display brightness of the second display subarea is closer to the display brightness of the first display subarea, so that the accuracy of gamma correction can be improved when gamma correction is performed according to the display brightness.

Further, when measuring the display brightness of the display subarea, the display brightness at the geometric center of the display subarea may be determined as the display brightness of the display subarea. Since the display brightness at the geometric center of the display subarea is less affected by the brightness of other display subareas, the interference of other display subareas on the display brightness of the display subarea can be greatly reduced, and the accuracy of the measured display brightness is ensured.

For example, when the display panel includes a high-resolution area and a low-resolution area, the display area of the low-resolution area is smaller than the reference area threshold, and the display area of the high-resolution area is much larger than the reference area threshold. When displaying an image having the same image resolution as that of the low-resolution area, the display brightness can be measured at the geometric center of the high-resolution area, and the display brightness of the measured high-resolution area is determined as the display brightness of the low-resolution area. When the image having the same image resolution as that of the high-resolution area is displayed, the display brightness of the high-resolution area is directly measured.

At this time, in the process of acquiring the display brightness of the high-resolution area and the low-resolution area, the display brightness may be measured at the same position to obtain the display brightness of the display subareas having different resolutions. The equipment replacement and movement caused by the brightness measurement at different positions are avoided, and the unnecessary logistics action process in the production process is avoided, thereby simplifying the process of obtaining display brightness.

As an alternative implementation of the first implementation, in other scenarios where the display brightness of the first display subarea is inconvenient or cannot be directly measured, and the display brightness of the second display subarea can be directly measured, the display brightness of the second display subarea may be measured, and the display brightness of the second display subarea may be determined as the display brightness of the first display subarea, thereby obtaining the display brightness of the first display subarea. For example, the other scenarios may include, but are not limited to: when the display area of the first display subarea is slightly larger than the reference area threshold, and the difference between the display brightness of the first display subarea and the display subarea located adjacent to it is large. If the display brightness of the first display subarea is directly measured, the measured display brightness of the first display subarea may be affected by the display brightness of the adjacent display subarea, thereby resulting in a scenario in which the display brightness of the first display subarea is inaccurate.

In one embodiment, corresponding to the second implementation manner of step 201, the implementation of the step 202 includes: measuring the display brightness of the plurality of display subareas separately. The process of measuring the display brightness of the display subarea in the second implementation manner may refer to the implementation process of measuring the display brightness of the display subarea in the first implementation manner, and details are not described herein again.

Step 203: Performing gamma correction on the display panel based on display brightness of the plurality of display subareas respectively to obtain a correction parameter of each display subarea.

In one embodiment, the display panel may be gamma-corrected in an order from low to high resolution to obtain correction parameters of the display subareas having the corresponding resolutions. In this way, when gamma correction is performed on the display panel according to the display brightness of the display subarea having a relatively high resolution, the influence of the correction process on the correction result corresponding to the display subarea having a relatively low resolution can be reduced. Thus, the accuracy of gamma correction on the display panel is further guaranteed.

There is a plurality of implementation manners for correcting the display panel. The following are described as two examples in the following embodiments of the present disclosure:

In one embodiment, the display panel may be gamma-corrected based on the display brightness of each display subarea to obtain a correction parameter corresponding to the display subarea.

Figure 3:
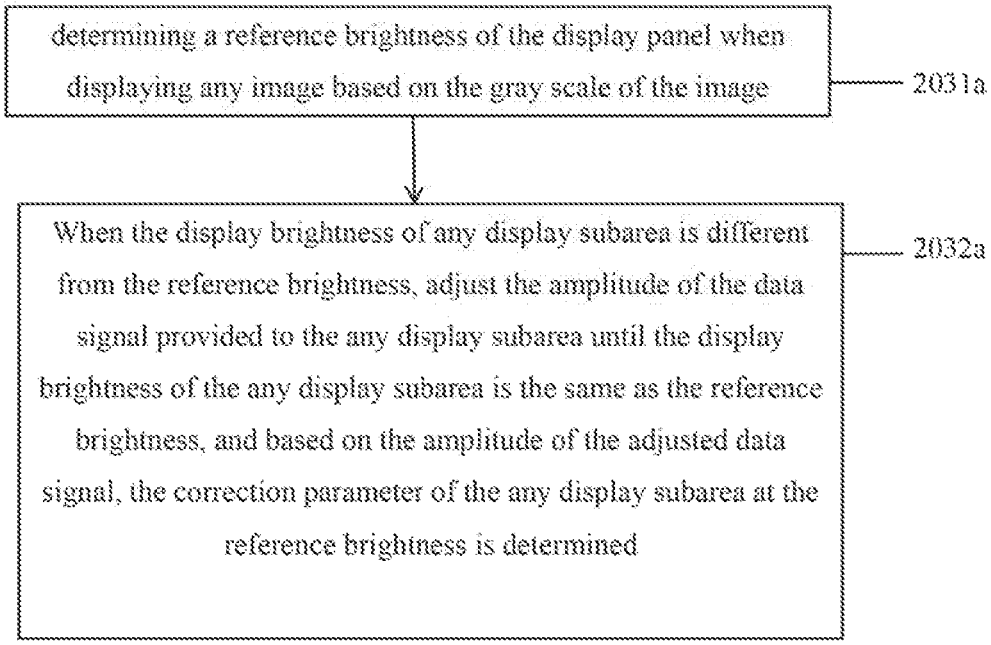
FIG. 3 is a flowchart of a method for performing gamma correction on a display panel based on display brightness of a plurality of display subareas according to an embodiment of the present disclosure.

Optionally, the correction parameter of the display subarea may be characterized by the amplitude of the data signal provided to the display subarea, and the display brightness of the display subarea may be determined based on the amplitude of the data signal provided to the display subarea. Correspondingly, in one embodiment, as shown in FIG. 3, performing the gamma correction of the display panel based on the display brightness of the display subarea having any resolution to obtain the correction parameter of the display subarea having any resolution may include:

Step 2031*a*: determining a reference brightness of the display panel when displaying any image based on the gray scale of the image.

According to the display theory, each gray scale can correspond to a plurality of brightness, that is, when the display panel displays an image of any gray scale, the display panel can display according to a plurality of brightness. For example, when the display panel displays an image of 200 gray scales, the display panel can be displayed in accordance with 400 nits, displayed in 500 nits, or displayed in 600 nits. Furthermore, when the maximum display brightness of the display panel is set to a fixed value, if the control display panel displays an image of any gray scale, the reference brightness (i.e., the ideal brightness) of the display panel when displaying the image may be determined based on the gray scale of the image. At this time, the correspondence between the gray scale and the reference brightness can be expressed by a standard gamma curve, that is, the reference brightness I, the maximum display brightness Imax, and the gray scale G satisfy: $I=ImaX\times(G/255)^{2.2}$.

Therefore, when the step 2031*a* is performed, the reference brightness can be determined according to the maximum brightness when the image is displayed on the display panel and the gray scale of the image. For example, in the process of gamma correction, if the gray scale of the image displayed by the display panel is 255, when the maximum brightness of the display panel is 500 nits, the reference brightness may be determined according to the gray scale and the maximum brightness, i.e., $I=500\times(255/255)^{2.2}=500$ nits.

Step 2032*a*: When the display brightness of any display subarea is different from the reference brightness, adjust the amplitude of the data signal provided to the any display subarea until the display brightness of the any display subarea is the same as the reference brightness. Based on the amplitude of the adjusted data signal, the correction parameter of the any display subarea at the reference brightness is determined.

Before the display panel is corrected, an initial correction parameter is usually stored in the display panel, and in step 201, the display panel may be controlled to perform image display according to the initial correction parameter. When the display brightness of any display subarea is different from the reference brightness, it indicates that the initial correction parameter stored in the display panel is not satisfactory. At this time, the initial correction parameter may be adjusted such that the data signal provided to the any display subarea is adjusted according to the adjusted correction parameter until the display brightness of any display subarea is the same as the reference brightness (or within the error range). Then, the adjusted initial correction parameter is determined as the correction parameter of the any display subarea at the reference brightness.

Figure 4:
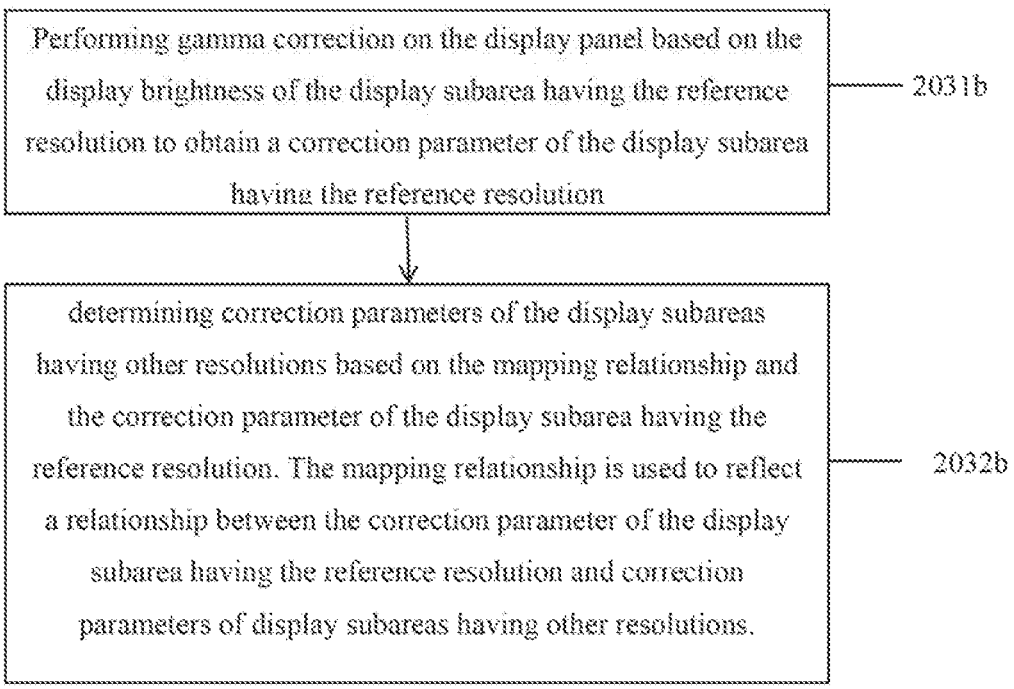
FIG. 4 is a flow chart of another method for performing gamma correction on a display panel based on display brightness of a plurality of display subareas according to an embodiment of the present disclosure.

In another implementation manner, the correction parameters of some display subareas may be acquired according to the above steps 2031*a* and 2032*a*. Then, the correction parameters of the other display subareas are obtained according to the mapping relationship between the other display subareas and the some display subareas, thereby getting the correction parameters for all display subareas. As shown in FIG. 4, the implementation process may include:

Step 2031*b*: Performing gamma correction on the display panel based on the display brightness of the display subarea having the reference resolution to obtain a correction parameter of the display subarea having the reference resolution.

The display subarea having the reference resolution may include at least one display subarea in the display panel, for example, the display subarea having the reference resolution may be a high resolution area in the display panel. For the implementation process of the step 2031*b*, refer to the implementation process of the step 2031*a* and the step 2032*a*, and details are not described herein again.

Step 2032*b*, determining correction parameters of the display subareas having other resolutions based on the mapping relationship and the correction parameter of the display subarea having the reference resolution. The mapping relationship is used to reflect a relationship between the correction parameter of the display subarea having the reference resolution and correction parameters of display subareas having other resolutions. The other resolution is a resolution other than the reference resolution among the resolutions of the plurality of display subareas.

Optionally, a first relationship between display brightness of the display subarea having the reference resolution and the reference brightness and a second relationship between the display brightness of the third display subarea and the reference brightness may be acquired by using big data, and then the mapping relationship may be determined based on the first relationship and the second relationship.

After determining the correction parameter of the display subarea having the reference resolution, the correction parameter of each display subarea having other resolution may be calculated according to the mapping relationship and the correction parameter of the display subarea having the reference resolution. For example, the correction parameter of the high-resolution area may be acquired according to the above steps 2031*a* and 2032*a*, and the mapping relationship between the high-resolution area and the low-resolution area may be acquired. Then, the correction parameter of the low-resolution area is calculated according to the correction parameter of the high-resolution area and the mapping relationship.

By obtaining the correction parameters of some display subareas according to the above steps 2031*a* and 2032*a*, and then calculating the correction parameters of the other display subareas according to the mapping relationship between the correction parameters of some display subareas and the correction parameters of the other display subareas, it can shorten the time required for gamma correction of the display panel, thereby increasing productivity.

It should be noted that the above steps 201 to 203 are for realizing the implementation process of obtaining the correction parameters of the display subareas under a certain gray scale and a certain maximum display brightness (i.e., the correction parameter at the corresponding reference brightness). Since the display subareas have different display conditions under different gray scales and different maximum display brightness, in the process of gamma correction, it is usually necessary to correct the display subareas for different gray scales and different maximum display brightness to obtain correction parameters of display subareas at different gray scales and different maximum brightness. As such, a suitable signal can be provided to the display panel according to the corresponding correction parameter based on the gray scale of the image that the display panel needs to display and the maximum display brightness of the display panel during subsequent use of the display panel, thereby ensuring the display effect a the display panel.

Therefore, after obtaining the correction parameter of the display subarea at a certain gray scale and a certain maximum display brightness, the display panel may continue to be controlled to display other gray scale images at the certain maximum display brightness. Furthermore, the above steps 201 to 203 may be repeated to obtain correction parameters of different gray scales under the certain maximum display brightness. Then, after adjusting the maximum display brightness, the display panel may be repeatedly corrected according to the above correction process to obtain correction parameters corresponding to different gray scales and different maximum display brightness. Alternatively, the gray scale may be fixed first and the maximum display brightness is adjusted, and the display panel is repeatedly corrected according to the above correction process to obtain correction parameters under different maximum display brightness. Then, the gray scale is adjusted, and the correction process is repeated according to the above correction process to obtain correction parameters corresponding to different gray scales and different maximum display brightness.

Figure 5:
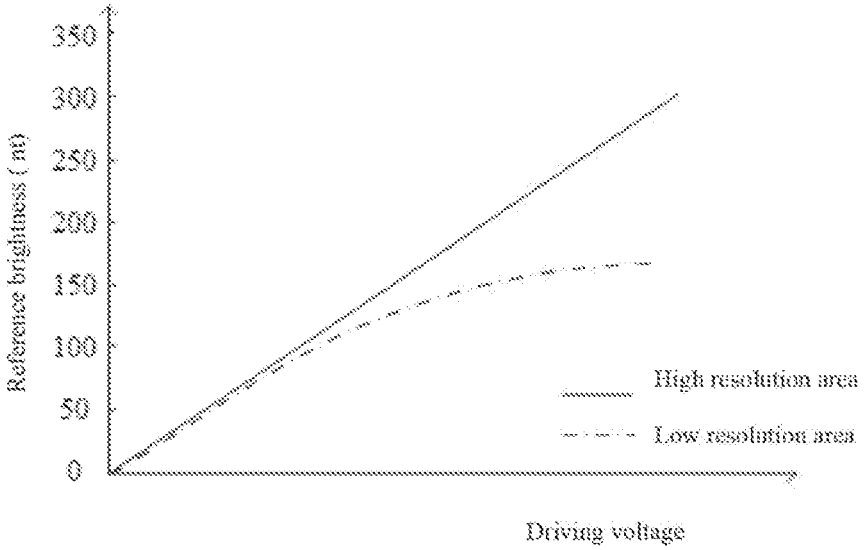
FIG. 5 is a schematic diagram of a law for satisfying a relationship between a amplitude and a reference brightness of a data signal loaded into a pixel unit in a display subarea having different resolutions according to an embodiment of the present disclosure.

Moreover, referring to FIG. 5, in the process of respectively controlling the display panel to display according to the plurality of reference brightness, the correspondence between the amplitudes of the data signals provided to the pixel units in the display subareas having different resolutions and the reference brightness may meet the following rules: For display subareas having a resolution greater than or equal to the reference resolution threshold (e.g., a high resolution area), the amplitude of the data signal provided to the pixel units in the display subarea vary in a linear function with the plurality of reference brightness. For display subareas having a resolution less than the reference resolution threshold (e.g., a low resolution area), the amplitude of the data signal provided to the pixel units in the display subarea vary in a convex function with the plurality of reference brightness.

When the correspondence between the amplitude of the data signal loaded into the pixel units in the display subarea having different resolutions and the reference brightness satisfies the above rule, when the reference brightness is low, the display brightness of the display subarea can be rapidly increased as the reference brightness increases, thereby making the lower resolution display subarea close to the brightness of the higher resolution display subarea. When the reference brightness is high, the display brightness of the lower resolution display subarea increases slowly as the reference brightness increases, but visually ensures that the display brightness difference between the lower resolution display subarea and the higher resolution display subarea becomes larger. Moreover, the current flowing through the pixel units in the lower resolution display subarea can be reduced, thereby ensuring the service life of the display subarea.

Step 204: Storing the correction parameter of each display subarea, and drive the pixel units in the corresponding display subarea according to the stored correction parameter during the display process.

After obtaining the correction parameter corresponding to each display subarea, the correction parameter and the correspondence between the correction parameter and the display subarea may be stored in a register of the display panel. As such, when controlling the corresponding display subarea to display according to the corresponding gray scale and under the corresponding maximum display brightness, a driving signal may be provided to the display subarea according to the correction parameter, and accordingly the display effect of the display panel is ensured.

Moreover, since the gamma correction needs to be performed separately for different display subareas after the gamma correction process for each display subarea is completed, the correction parameters corresponding to the display subareas may be stored to ensure that the gamma correction process between different display subareas does not affect each other. Furthermore, when gamma correction is performed for other display subareas, the stored correction parameters are not changed. For example, gamma correction may be performed first for the low-resolution areas, and after the correction is completed, the correction parameters corresponding to the low-resolution areas are stored in the register. Then, gamma correction is performed for the high-resolution areas. After the correction is completed, the correction parameters corresponding to the high-resolution areas are stored in the register, and the stored correction parameters corresponding to the low-resolution areas are not changed in the storage process.

The gamma correction method provided by some embodiments of the present disclosure performs gamma correction on the display panel by acquiring display brightness of a plurality of display subareas displaying images, and perform gamma correction of the display panel based on the display brightness of the plurality of display subareas respectively to obtains a correction parameter of each display subarea. Compared with the related art, the gamma correction according to some embodiments of the present disclosure can be performed separately for different display subareas, which improves the granularity of gamma correction on the display panel. It can be applied to gamma correction of a display panel with ununiformed pixel density, which ensures the accuracy of gamma correction of the display panel, thereby ensuring the display effect of the display panel.

It should be noted that the sequence of the steps of the gamma correction method provided by the embodiment of the present disclosure may be appropriately adjusted, and the steps may also be correspondingly increased or decreased according to the situation. Any method that can be easily conceived within the scope of the present disclosure within the technical scope of the present disclosure is well within the scope of the present disclosure, and therefore will not be described again.

Figure 6:
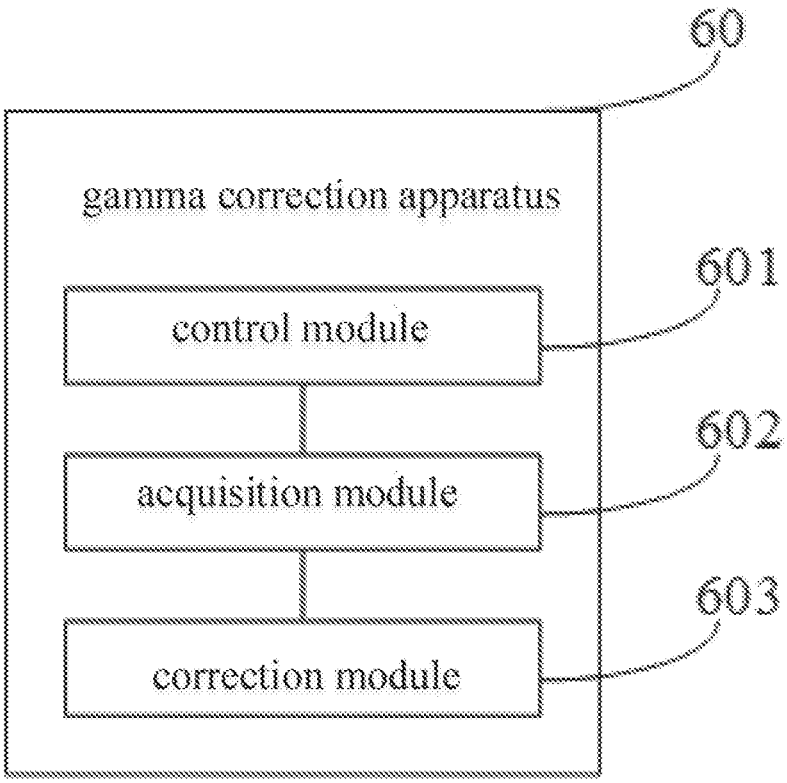
FIG. 6 is a schematic structural diagram of a gamma correction apparatus according to an embodiment of the present disclosure.

One embodiment of the present disclosure provides a gamma correction apparatus. As shown in FIG. 6, the apparatus 60 may include:

Control module 601, configured to control a display panel to perform image display. The display panel includes at least two display subareas having different resolutions. The image displayed by the display panel has an image resolution that is greater than a resolution of at least one display subarea.

Acquisition module 602, configured to acquire display brightness of a plurality of display subareas displaying images.

Correction module 603, configure to perform gamma correction on the display panel based on the display brightness of the plurality of display subareas respectively to obtain a correction parameter of each display subarea.

In summary, the gamma correction apparatus provided by one embodiment of the present disclosure acquires display brightness of a plurality of display subareas displaying images and performs gamma correction on the display panel based on the display brightness of the plurality of display subareas respectively to obtain a correction parameter of each display subarea. Compared with the related art, the gamma correction according to one embodiment of the present disclosure can be performed separately for different display subareas, which improves the granularity of gamma correction on the display panel. It can be applied to gamma correction of a display panel with ununiformed pixel density and ensures the accuracy of gamma correction of the display panel, thereby ensuring the display effect of the display panel.

Optionally, the control module 601 is configured to control the display panel to display a plurality of images having different image resolutions in a time-sharing manner. The plurality of images has image resolutions correspondingly equal to resolutions of the plurality of display subareas.

Optionally, when an image is displayed on the display panel, a display subarea performs display of the image with a target resolution, which is the lower resolution between the resolution of the display subarea and the image resolution of the image.

Optionally, the acquisition module 602 is configured to perform the following: when the display panel displays any image, if a display area of the first display subarea among the plurality of display subareas is smaller than a reference area threshold, the display brightness of the second display subarea is used as the display brightness of the first display subarea.

Wherein, the first display subarea has the same resolution as the image resolution of the any image, and the second display subarea is a subarea, among the plurality of display subareas, that is different in resolution from the first display subarea and has a display area greater than the reference area threshold.

In one embodiment, the correction module 603 is configured to perform gamma correction on the display panel based on the display brightness of the display subarea having any resolution to obtain a correction parameter of the display subarea having any resolution.

In one embodiment, the correction module 603 is configured to perform gamma correction on the display panel based on the display brightness of the display subarea having the reference resolution to obtain a correction parameter of the display subarea having the reference resolution.

The correction module 603 is further configured to determine correction parameters of display subareas having other resolutions based on mapping relationship and the correction parameter of the display subarea having reference resolution. The mapping relationship is used to reflect the relationship between the correction parameter of the display subarea having the reference resolution and the correction parameters of the display subareas having other resolutions, and other resolutions are resolutions other than the reference resolution among the resolutions of the plurality of display subareas.

Optionally, the correction parameter of the display subarea is characterized by the amplitude of the data signal provided to the display subarea, and the display brightness of the display subarea is determined based on the amplitude of the data signal provided to the display subarea. In one embodiment, the correction module is configured to:

determine the reference brightness of the display panel when displaying any image based on the gray scale of any image.

When the display brightness of any display subarea is different from the reference brightness, adjust the amplitude of the data signal provided to the any display subarea until the display brightness of the any display subarea is the same as the reference brightness. Based on the amplitude of the adjusted data signal, the correction parameters of any of the display subareas at the reference brightness are determined.

Optionally the display panel has a first display subarea and a second display subarea. The first display subarea has a first resolution smaller than a second resolution of the second display subarea, and a display area of the second display subarea is larger than a display area of the first display subarea.

The control module 601 is configured to control the first display subarea and the second display subarea to display a first image having the first resolution respectively according to the first reference brightness.

The acquisition module 602 is configured to acquire a first display brightness of the second display subarea.

The correction module 603 is configured to perform gamma correction on the display panel based on the first display brightness and the first reference brightness to obtain a correction parameter of the first display subarea at the first reference brightness.

The control module 601 is further configured to control the first display subarea and the second display subarea to display the second image having the second resolution according to the second reference brightness.

The acquisition module 602 is further configured to obtain a second display brightness of the second display subarea.

The correction module 603 is further configured to perform gamma correction on the display panel based on the second display brightness and the second reference brightness to obtain a correction parameter of the second display subarea at the second reference brightness.

In summary, in the gamma correction apparatus provided by one embodiment of the present disclosure, the acquisition module acquires display brightness of a plurality of display subareas when displaying images, the correction module performs gamma correction on the display panel based on the display brightness of the plurality of display subareas, and obtains a correction parameter of each display subarea. Compared with the related art, the gamma correction according to one embodiment of the present disclosure can be performed separately for different display subareas, which improves the granularity of gamma correction on the display panel. It can be applied to gamma correction of a display panel with ununiformed pixel density, and ensures the accuracy of gamma correction of the display panel, thereby ensuring the display effect of the display panel.

One embodiment of the present disclosure provides a display apparatus, which comprises: a display panel and a gamma correction apparatus provided by an embodiment of the present disclosure, wherein the gamma correction apparatus is configured to perform gamma correction on the display panel.

Optionally, the display panel can be any product or component that has a display function, such as: a liquid crystal panel, an organic light emitting diode (OLED for short) display panel, an AMOLED display panel, an electronic paper, a mobile phone, a tablet computer, a television, monitor, laptop, digital photo frame, navigator, etc.

Moreover, the display apparatus may further include: a target function assembly. The display panel includes a plurality of display subareas with different resolutions, and the orthographic projection of the target function assembly on the display panel covers an orthographic projection of the display subarea having a resolution smaller than the reference resolution threshold on the display panel. The target function assembly operates based on light incident from the display side of the display panel. For example, the target function assembly includes at least one of the following: a camera assembly, a light sensor assembly, and a fingerprint detection assembly.

By setting the target function assembly below the display panel, it is easy to implement the technology such as fingerprint recognition under the screen, and the screen ratio can be further improved.

Some embodiments of the present disclosure provide a gamma correction apparatus, which may include: a processor and a memory, wherein, A memory, configured for storing a computer program.

A processor, configured for executing the computer program stored on the memory to implement a gamma correction method as in an of the embodiments of the present disclosure.

Alternatively, the gamma correction apparatus can be integrated on a chip.

Some embodiments of the present disclosure provide a computer storage medium, which may be a non-volatile storage medium, capable of performing gamma correction as in any of the embodiments of the present disclosure when a program in the storage medium is executed by the processor.

A person skilled in the art may understand that all or part of the steps of implementing the above embodiments may be completed by hardware, or may be instructed by a program to execute related hardware, and the program may be stored in a computer readable storage medium. The storage medium mentioned may be a read only memory, a magnetic disk or an optical disk or the like.

The above is only an alternative embodiment of the present disclosure and is not intended to limit the present disclosure. Any modifications, equivalent substitutions, improvements, etc. made within the spirit and scope of the present disclosure are intended to be included within the scope of the present disclosure.

The principles and the embodiments of the present disclosure are set forth in the specification. The description of the embodiments of the present disclosure is only used to help understand the apparatus and method of the present disclosure and the core idea thereof. Meanwhile, for a person of ordinary skill in the art, the disclosure relates to the scope of the disclosure, and the technical scheme is not limited to the specific combination of the technical features, but also covers other technical schemes which are formed by combining the technical features or the equivalent features of the technical features without departing from the inventive concept. For example, a technical scheme may be obtained by replacing the features described above as disclosed in this disclosure (but not limited to) with similar features.

What is claimed is:

1. A gamma correction method, the method comprising:

controlling a display panel to perform image display, the display panel comprising a plurality of display subareas, at least two of the plurality of display subareas having different resolutions, an image displayed by the display panel has an image resolution that is greater than a resolution of at least one of the plurality of display subareas;

obtaining display brightness of the plurality of display subareas performing image display; and performing gamma correction on the display panel based on the display brightness of the plurality of display subareas respectively to obtain a correction parameter of each of the plurality of display subareas;

wherein controlling, the display panel to perform the image display comprising:

controlling the display panel to display a plurality of images having different image resolutions in a time-sharing manner, the plurality of images having the image resolutions correspondingly equal to resolutions of the plurality of display subareas respectively;

wherein one of the plurality of display subareas displays one of the plurality of images with a target resolution, which is the lower resolution between a resolution of the one of the plurality of display subareas and an image resolution of the one of the plurality of images.

2. The method according to claim 1, wherein obtaining the display brightness of the plurality of display subareas performing image display comprising:

using a display brightness of a second display subarea among the plurality of display subareas as a display brightness of a first display subarea among time plurality of display subareas, wherein a display area of the first display subarea among the plurality of display subareas is smaller than a reference area threshold; the first display subarea has a same resolution as the image resolution of the image, and the second display subarea is a subarea, among the plurality of display subareas, that is different in resolution from the first display subarea and has a display area greater than the reference area threshold.

3. The method according to claim 2, wherein the first display subarea has a first resolution smaller than a second resolution of the second display subarea, and the display area of the second display subarea is larger than the display area of the first display subarea, the method comprising:

controlling the first display subarea and the second display subarea to display a first image with the first resolution according to a first reference brightness;

acquiring a first display brightness of the second display subarea;

performing gamma correction on the display panel based on the first display brightness and the first reference brightness to obtain a correction parameter of the first display subarea at the first reference brightness;

controlling the first display subarea and the second display subarea to display a second image with the second resolution according to a second reference brightness;

acquiring a second display brightness of the second display subarea; and performing gamma correction on the display panel based on the second display brightness and the second reference brightness to obtain a correction parameter of the second display subarea at the second reference brightness.

4. The method according to claim 1, wherein performing the gamma correction on the display panel based on the display brightness of the plurality of display subareas respectively to obtain a correction parameter of each of the plurality of display subareas comprises:

performing the gamma correction on the display panel based on the display brightness of each of the plurality of display subareas having any resolution to obtain a correction parameter of each of the plurality of display subareas having any resolution.

5. The method according to claim 4, wherein the gamma correction is performed in an order from low to high resolutions of the plurality of display subareas to obtain correction parameters of the display subareas having the corresponding resolutions.

6. The method according to claim 1, wherein performing the gamma correction on the display panel based on the display brightness of the plurality of display subareas respectively to obtain a correction parameter of each of the plurality of display subareas comprises:

performing the gamma correction on the display panel based on the display brightness of a display subarea having a reference resolution to obtain a correction parameter of the display subarea having the reference resolution; and determining correction parameters of the display subareas having other resolutions based on mapping relationship and the correction parameter of the display subarea having the reference resolution, wherein the other resolutions are resolutions other than the reference resolution, and the mapping relationship is configured to reflect relationship between the correction parameter of the display subarea having the reference resolution and the correction parameters of the display subareas having the other resolutions.

7. The method according to claim 1, wherein performing the gamma correction on the display panel based on the display brightness of the plurality of display subareas respectively to obtain a correction parameter of each of the plurality of display subareas comprising:

determining a reference brightness of the display panel when displaying the image based on a gray scale of the image;

adjusting an amplitude of a data signal provided to one of the display subareas until a display brightness of the one of the display subareas is the same as the reference brightness, wherein the display brightness of the one of the display subareas is different from the reference brightness; and determining a correction parameter of the one of the display subareas at the reference brightness based on the amplitude of the adjusted data signal.

8. The method according to claim 1, further comprising storing the correction parameter of each display subarea, and drive pixel units in the corresponding display subarea according to the stored correction parameter of each display subarea during the display process.

9. A gamma correction apparatus, comprising: a processor and a memory, wherein, the memory is configured for storing computer programs, the processor is configured for executing a computer program stored on the memory to implement the gamma correction method as in claim 1.

* * * * *